US012214292B2

(12) United States Patent
McKenna et al.

(10) Patent No.: US 12,214,292 B2
(45) **Date of Patent: *Feb. 4, 2025**

(54) STORAGE DEVICE WITH MOVABLE ELEMENT

(71) Applicant: Spin Master Ltd., Toronto (CA)

(72) Inventors: Sean McKenna, Toronto (CA); Vanessa R. Raponi, Toronto (CA)

(73) Assignee: Spin Master Ltd., Toronto (CA)

( * ) Notice: Subject to any disclaimer, the term of this patent is extended or adjusted under 35 U.S.C. 154(b) by 10 days.

This patent is subject to a terminal disclaimer.

(21) Appl. No.: 17/821,502

(22) Filed: Aug. 23, 2022

(65) Prior Publication Data

US 2023/0069632 A1 Mar. 2, 2023

Related U.S. Application Data

(63) Continuation-in-part of application No. 17/464,105, filed on Sep. 1, 2021, now Pat. No. 11,419,399.

(51) Int. Cl.
*A63H 3/40* (2006.01)
*A45C 1/02* (2006.01)
(Continued)

(52) U.S. Cl.
CPC ..... *A63H 3/40* (2013.01); *A45C 1/02* (2013.01); *A45C 13/103* (2013.01); *A45C 15/00* (2013.01); *A63H 29/02* (2013.01)

(58) Field of Classification Search
CPC .. A63H 3/04; A63H 29/02; A45C 1/02; A45C 13/103; A45C 15/00
See application file for complete search history.

(56) References Cited

U.S. PATENT DOCUMENTS

D176,947 S 2/1956 Kather
D189,955 S 3/1961 Kather
(Continued)

FOREIGN PATENT DOCUMENTS

CN 206472990 U 9/2017
CN 107866077 A 4/2018
(Continued)

OTHER PUBLICATIONS

Screen capture from YouTube video clip entitled "Introducing Wow Packs! The world's first animated backpack!," 1 page, uploaded on Jun. 17, 2013 by user "Wow! Stuff" [retrieved Aug. 26, 2021]. Retrieved from Internet: <https://www.youtube.com/watch?v=MMetDOPEvsw>.

(Continued)

*Primary Examiner* — Tri M Mai
(74) *Attorney, Agent, or Firm* — Aird & McBurney LP

(57) ABSTRACT

In an aspect, a storage device is provided and includes a container including an exterior surface and an opening therethrough. The storage device further includes at least one movable facial feature element. The storage device further includes an actuator operatively connected to the at least one movable facial feature element for driving movement of the at least one movable facial feature element. The storage device further includes a closure structure extending along the opening, and a traveler that is movably mounted to the closure structure for movement between a first traveler position and a second traveler position to open or close the closure structure. A coupling arrangement connects the traveler to the actuator such that movement of the traveler drives movement of the actuator, which in turn drives movement of the at least one movable facial feature element.

14 Claims, 9 Drawing Sheets

(51) Int. Cl.

| | |
|---|---|
| ***A45C 13/10*** | (2006.01) |
| ***A45C 15/00*** | (2006.01) |
| ***A63H 29/02*** | (2006.01) |

(56) References Cited

U.S. PATENT DOCUMENTS

| | | | | |
|---|---|---|---|---|
| D189,956 | S | 3/1961 | Kather | |
| 3,672,096 | A | 6/1972 | Johmann | |
| 3,867,971 | A | 2/1975 | Hazan | |
| 4,103,455 | A | 8/1978 | Silvey | |
| 4,174,059 | A | 11/1979 | Maunder | |
| D302,766 | S | 8/1989 | Johnston | |
| D324,770 | S | 3/1992 | Dixsaut | |
| D335,027 | S | 4/1993 | Flood | |
| 5,222,642 | A | 6/1993 | Solarz | |
| 5,304,087 | A | 4/1994 | Terzian et al. | |
| D438,700 | S | 3/2001 | Willingham | |
| 6,247,730 | B1 | 6/2001 | Henderson et al. | |
| D457,313 | S | 5/2002 | Clark | |
| 6,875,074 | B1 | 4/2005 | Morris | |
| D632,480 | S | 2/2011 | Lacorte | |
| 7,942,720 | B1 | 5/2011 | Galoustian | |
| D668,451 | S | 10/2012 | Katoh | |
| 8,393,906 | B2 | 3/2013 | Norman et al. | |
| 8,674,211 | B1 | 3/2014 | Marianne | |
| D715,540 | S | 10/2014 | Ghisellini | |
| D720,132 | S | 12/2014 | Zhou | |
| 9,155,973 | B2 | 10/2015 | Hengel et al. | |
| D745,265 | S | 12/2015 | Jabbour, Jr. | |
| 9,215,914 | B2 | 12/2015 | Strong | |
| 9,474,981 | B1 | 10/2016 | Forti | |
| D785,102 | S | 4/2017 | Ruffin, Jr. | |
| D803,550 | S | 11/2017 | Shaholli | |
| D804,167 | S | 12/2017 | Shaholli | |
| D809,785 | S | 2/2018 | Lee | |
| D827,296 | S | 9/2018 | Sun | |
| D847,498 | S | 5/2019 | Dumas | |
| 10,421,027 | B2 | 9/2019 | Sufer et al. | |
| 10,518,183 | B2 | 12/2019 | Evazians | |
| 10,674,801 | B2 | 6/2020 | Noguera Ramis | |
| D919,961 | S | 5/2021 | Sprintz | |
| D932,180 | S | 10/2021 | Lin | |
| D947,296 | S | 3/2022 | Luo | |
| D951,630 | S | 5/2022 | Abloh | |
| 11,419,399 | B1 | 8/2022 | McKenna | |
| 2004/0179756 | A1* | 9/2004 | Kani | A45C 13/08 224/656 |
| 2005/0279794 | A1* | 12/2005 | Gerchen | A45F 3/042 224/576 |
| 2008/0014830 | A1 | 1/2008 | Sosnovskiy et al. | |
| 2009/0293999 | A1 | 12/2009 | Bravo-Olsher et al. | |
| 2018/0370039 | A1 | 12/2018 | Nakagome et al. | |
| 2019/0143528 | A1 | 5/2019 | Hayashi | |
| 2019/0231045 | A1 | 8/2019 | Jian | |
| 2019/0239625 | A1* | 8/2019 | Westrick | A45F 3/042 |

FOREIGN PATENT DOCUMENTS

| | | | |
|---|---|---|---|
| CN | 109289207 | A | 2/2019 |
| CN | 109289208 | A | 2/2019 |
| CN | 111514590 | A | 8/2020 |
| ES | 2288324 | A1 | 10/2008 |
| IT | PI20100053 | A1 | 10/2011 |
| KR | 101874978 | B1 | 7/2018 |
| KR | 20190065132 | A | 6/2019 |

OTHER PUBLICATIONS

Screen capture from YouTube video clip entitled "Electronic Wow Packs Cutezee the Kitten from Wow Stuff," 1 page, uploaded on Jan. 24, 2014 by user "TTPM Toy Reviews" [retrieved Aug. 26, 2021]. Retrieved from Internet: <https://www.youtube.com/watch?v=CzRN36xdCN0>.

Screen capture of "Cat Suitcase", XP055822985, published Mar. 12, 2017 [retrieved Jul. 9, 2021]. Retrieved from Internet: <https://www.toxel.com/tech/2017/03/12/ cat-suitcase/>.

EP21158521, European Search Report, European Patent Office, dated Jul. 20, 2021.

English translation of CN206472990U.

English translation of ITPI20100053A1.

English translation of KR1020190065132A.

English translation of KR101874978B1.

English translation of CN109289207A.

English translation of CN107866077A.

English translation of CN109289208A.

English translation of ES2288324B1.

English translation of CN111514590A.

Screen capture of "Animal plastic coin purse moving eyes frog vinyl coin bag toys", [retrieved Feb. 11, 2022]. Retrieved from Internet: <https://www.alibaba.com/product-detail/Animal-plastic-coin-purse-moving-eyes_60426301877.html>.

* cited by examiner

STORAGE DEVICE WITH MOVABLE ELEMENT

CROSS-REFERENCE TO RELATED APPLICATIONS

This application is a continuation-in-part of U.S. patent application Ser. No. 17/464,105 filed Sep. 1, 2021, the contents of which are incorporated herein by reference in their entirety.

FIELD OF THE INVENTION

The present disclosure relates generally to a storage device. In particular, the present disclosure relates to a storage device having at least one changeable facial feature structure.

BACKGROUND OF THE INVENTION

Backpacks and purses are known to be provided with features that represent facial features of a character. In some cases these features are movable. However, it would be desirable to provide a simple way of generating movement of a feature on a storage device, to increase the entertainment value of the storage device.

SUMMARY OF THE INVENTION

According to an aspect of the present disclosure, there is provided a storage device for carrying items. The storage device includes a container defining an interior for storage of items, the container including an exterior surface and an opening therethrough for accessing the interior. The storage device further includes at least one facial feature structure that is visible from outside the storage device and includes at least one movable facial feature element. The storage device further includes at least one actuator that is operatively connected to the at least one movable facial feature element for driving movement of the at least one movable facial feature element. The storage device further includes a closure structure extending along the opening, and a traveler that is movably mounted to the closure structure for movement between a first traveler position and a second traveler position. Movement of the traveler towards the first traveler position opens the closure structure so as to open the opening, and movement of the traveler towards the second traveler position closes the closure structure to close the opening. The storage device further includes a coupling arrangement operatively connecting the traveler to the actuator such that movement of the traveler from one of the first traveler position and the second position to the other of the first traveler position and the second position drives movement of the at least one actuator, which in turn drives movement of the at least one movable facial feature element.

In another embodiment, the disclosure is directed to a storage device for carrying items. The storage device includes a container defining an interior for storage of items. The container includes an exterior surface and an opening therethrough for accessing the interior. The storage device includes at least one feature structure that is visible from outside the storage device. The at least one feature structure includes a representation of a feature of an animate object that that is distinct from the storage device. The at least one feature structure includes at least one movable feature element. The storage device includes at least one actuator that is operatively connected to the at least one movable feature element for driving movement of the at least one movable feature element. The storage device includes a closure structure extending along the opening, and a traveler that is movably mounted to the closure structure for movement between a first traveler position and a second traveler position. Movement of the traveler towards the first traveler position opens the closure structure so as to open the opening, and movement of the traveler towards the second traveler position closes the closure structure to close the opening. The storage device includes a coupling arrangement operatively connecting the traveler to the actuator such that movement of the traveler from one of the first traveler position and the second position to the other of the first traveler position and the second position drives movement of the at least one actuator, which in turn drives movement of the at least one movable feature element.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
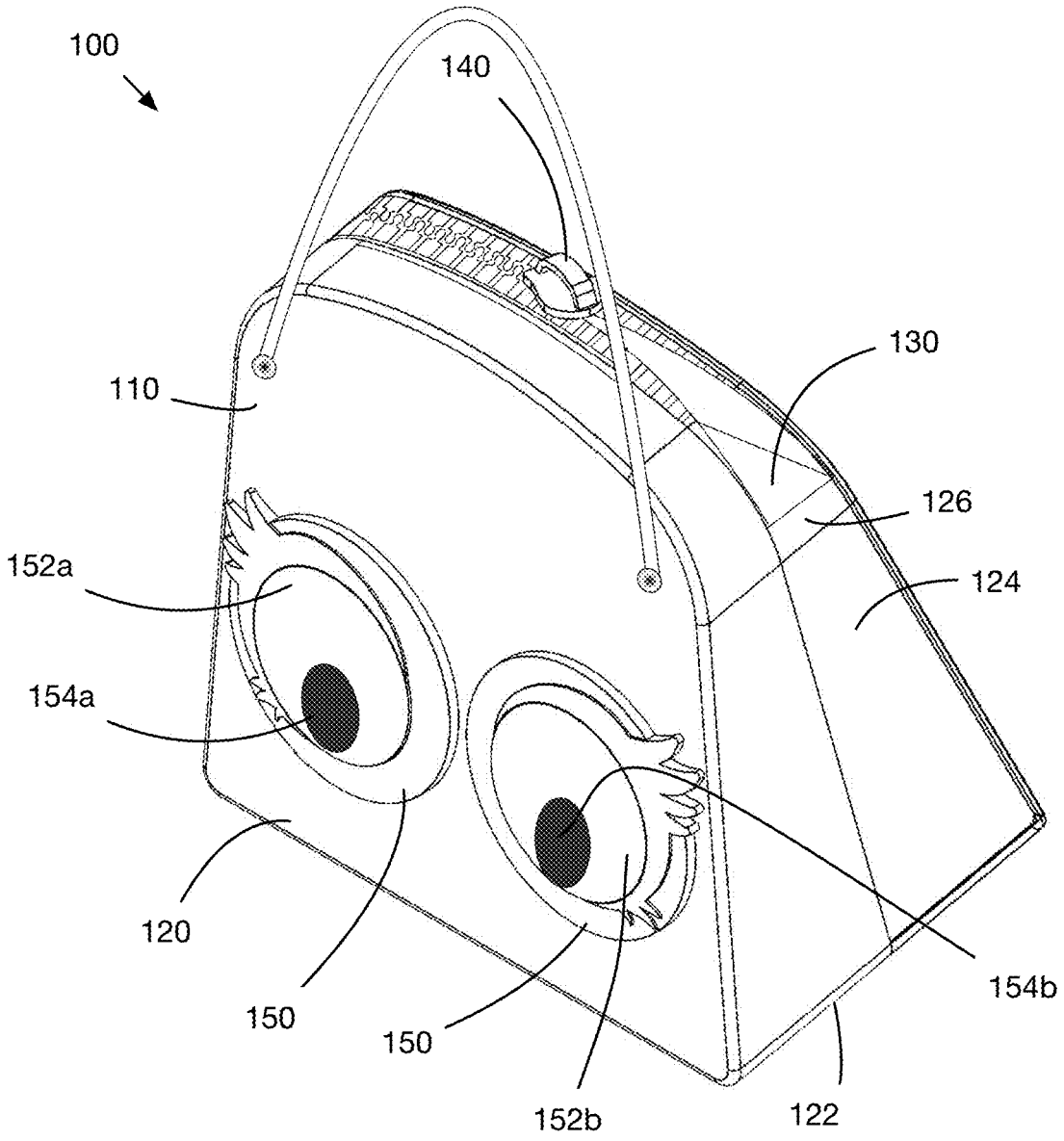
FIG. 1 shows an embodiment of the container of the storage device having a pair of facial feature structures that represent eyes, with movable facial feature elements, which represent pupils of the eyes, and a closure structure and traveler.

For simplicity and clarity of illustration, where considered appropriate, reference numerals may be repeated among the drawings to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the drawings and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The storage device in accordance with an embodiment of the present disclosure is generally formed to hold the personal items of a user, for example a child. The storage device in accordance with an embodiment of the present disclosure is for storing personal items and has an outer appearance that resembles a caricature of an animal or pet. The storage device preferably includes at least a head portion that has at least one facial feature (e.g., a pair of eyes, eyebrows, a mouth). The toy includes a motion driving system for driving a motion of a movable portion at least one facial feature that includes an actuator, a traveler and a coupling arrangement. In a preferred embodiment, the container, which constitutes a main structure of the storage device, acts as the "head" of the caricature animal. The storage device generally has an outer appearance that resembles an animal and can include eyes, ears, mouths, noses, a tail or other suitable facial or body features that may be found on a particular animal.

The storage device is generally comprised of a container having a storage pocket in which the personal items are stored. The storage device also includes an opening disposed about and extending along at least a portion of an outer edge of the container through which the storage pocket of the container is accessible.

In an embodiment, the container is semi-rigid and formed of material that is deformable or soft but is sufficiently sturdy so as to maintain a relatively consistent overall shape of the container. In a preferred embodiment, the container generally constitutes the "head" of the animal.

Referring to FIG. 1, an embodiment of the storage device 100 is provided. The container 110 of the storage device 100 includes at least a pair of generally opposed side faces 120 which are parallel or approximately parallel to one another. In this embodiment, the pair of side faces 120 each have a curved top edge and have bottom edges that are each joined to an outer edge of a bottom panel 122 and side edges that are joined to outer edges of opposing side panels 124 to form an approximately rectangular structure. The top of the container 110 includes a top panel joined to and fashioned along the curved top edge of each of the side faces 120.

The storage device 100 includes at least one facial feature structure 150 formed on at least one of the pair of side faces 120. The at least one facial feature structure 150 resembles at least one suitable facial feature of the animal (such as an eye, mouth, noes, eyebrows etc.) which the storage device 100 is impersonating.

At least a portion of the facial feature structure 150 is movable wherein the movement of the at least a portion of the facial feature structure 150 mimics a realistic movement based on the analogous facial feature.

The opening 130 of the container 110 can be closed or opened to secure the personal items held within the interior pouch. In the present embodiment, the opening 130 of the container 110 is disposed along at least a portion of the top panel and has a longitudinal slit form. In an additional embodiment, the opening 130 may extend beyond the length of the top panel and may also be disposed along at least a part of one or both side panels 124. The opening 130 may also extend so as to span along the top panel, both the side panels 124 and a portion of the bottom panel 122 such that when the opening 130 is opened, the pair of side faces 120 are substantially detached.

Figure 2B:
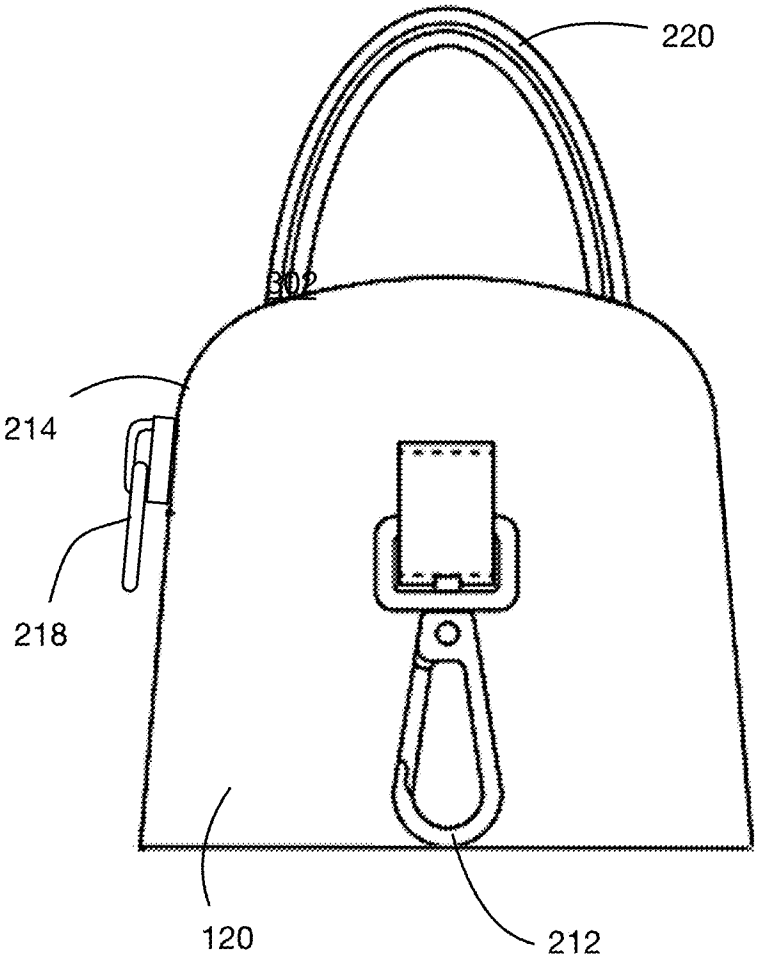
FIG. 2B is a rear view of the storage device shown in FIG. 1, showing a traveler for the closure structure.
Figure 2A:
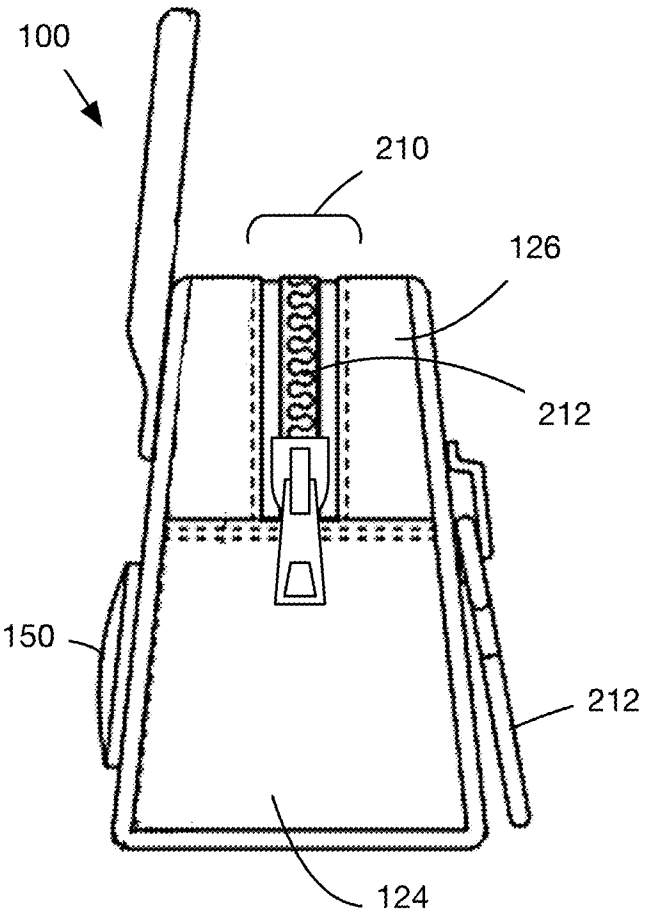
FIG. 2A is a side view of the storage device shown in FIG. 1, showing the closure structure.

In the embodiment presented in FIG. 2, the opening 130 extends along the length of the top panel from a top edge of each of the side panels 124 and has a slit form. A closure structure 210 is mounted to the edges of the opening 130 such that it surrounds and extends along a length of the opening 130. The closure structure 210 also includes a pair of closure securing elements. The closure securing elements of the closure structure 210 are a pair of rows of corresponding zipper teeth 212. The closure securing elements (rows of zipper teeth 212) extend along each opposing side of the opening 130 and are formed to be secured to and separated from one another to secure the opening 130 in an open or closed position.

The storage device 100 further includes a traveler 140 that is slidably mounted on the closure structure 210. The traveler 140 is formed to slide along the closure structure 210 between a first position whereby the opening 130 is at least partially open and a second position whereby the opening 130 is closed.

In a preferred embodiment, the traveler 140 engages with the pair of closure securing elements of the closure structure 210 as it slides along the closure structure 210 to separate of join the pair of closure securing elements, thereby opening 130 or closing at least a portion of the opening 130. Where the closure structure 210 is a pair of zipper teeth 212, the traveler 140 may be a sipper slider.

In the embodiment presented in FIG. 2, the traveler 140 is a zipper pull tab 218 that is connected to each of the pair of rows of corresponding zipper teeth 212. Sliding of the zipper pull tab 218 between a first position and a second position will drive a joining or a separating of at least a portion of the zipper teeth 212.

In the embodiment present in FIG. 2, the storage device 100 includes a handle 220 mounted on at least one of the side faces 120 of the container 110. The handle 220 may alternatively include a pair of handles mounted at corresponding positions on the pair of side faces 120. In the embodiment presented in FIG. 2, one of the pair of side faces 120 incudes the facial feature structure 150 while the other side of the pair of side faces 120 includes a carabiner 222 for securing the storage device 100 to another structure having an element upon which the carabiner 222 can latch (i.e. a strap of a backpack or child's schoolbag).

In an additional embodiment, the outer surfaces (which are shown in FIG. 1 as including faces 120, 122, 124 and 126) of the container 110 are entirely composed of the opposing pair of side face. In this embodiment, the pair of side faces 120 have matching forms and are joined together along at least part of a circumferential outer edge of each face. In this embodiment, each of the pair of side faces 120 may preferably have a circular form.

In the same embodiment where the outer surfaces of the container 110 include just the pair of side faces 120, the opening 130 of the container 110 is defined along the joined edges of the two side faces 120, where each of the side faces 120 are joined along the length of their circumferential edges, except for portion containing opening 130.

The at least one facial feature structure 150 may alternatively be referred to as the one or more facial feature structures 150. The one or more facial feature structures 150 are shaped and positioned on the container 110 to resemble one or more suitable facial feature of the animal (such as an eye, mouth, nose, eyebrows, etc.). The at least one facial feature structure 150 includes at least one movable facial feature element 154, which is movable so as to mimic a change of the facial feature. For example, the movable facial feature element could be movable to mimic a rolling of an eyeball within an eye, or a raising or furrowing of an eyebrow.

Figure 3:
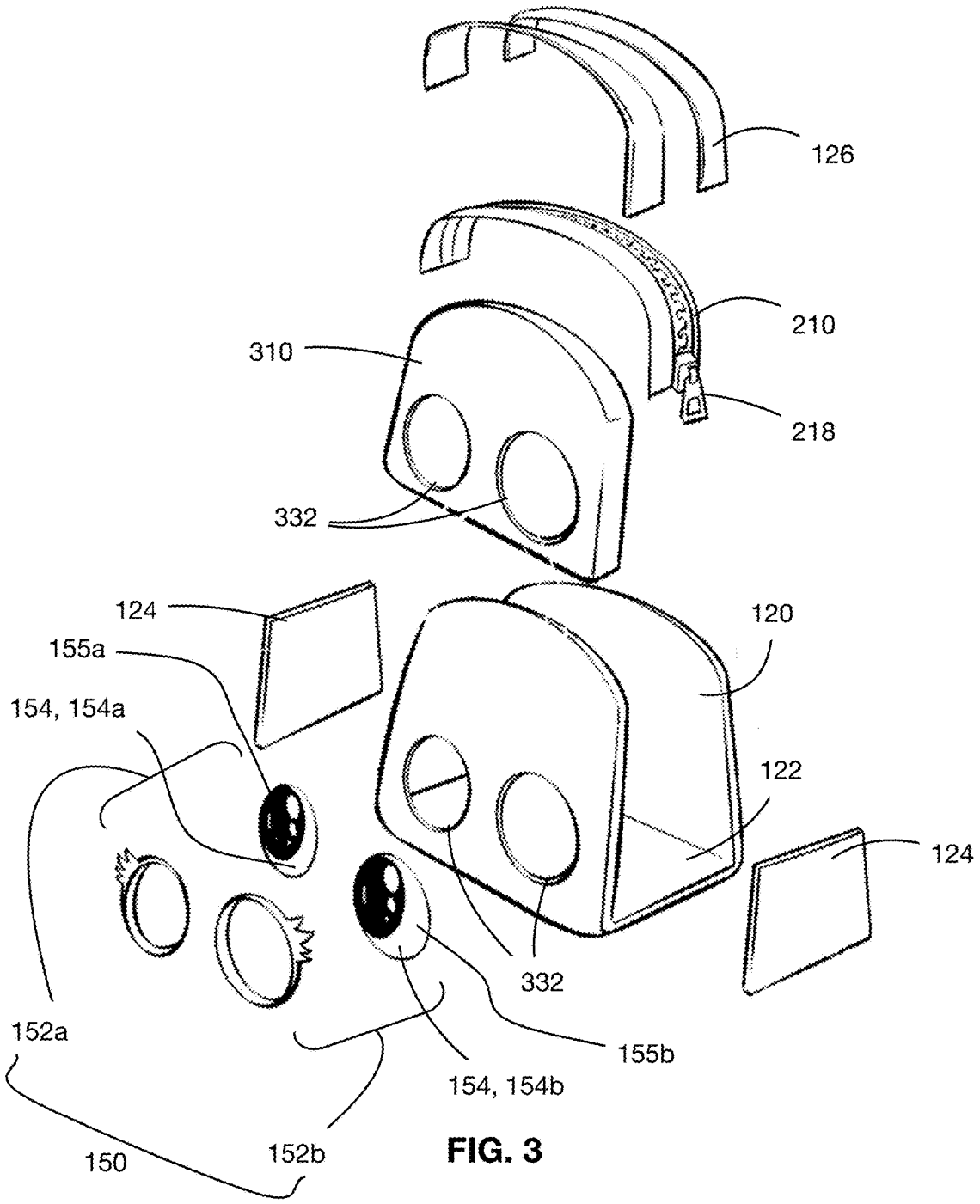
FIG. 3 shows an exploded perspective view of the storage device shown in FIG. 1.

In the embodiment presented in FIG. 1 and FIG. 3, the one or more facial feature structures 150 includes a plurality of eye structures 152, including a first eye structure 152*a* and a second eye structure 152*b* and the at least one movable facial feature element includes a first movable pupil member 154*a* and a second movable pupil member 154*b*.

The first movable pupil member 154*a* may be movable by being pivotable about a first movable pupil axis Amp1. The second movable pupil member 154*b* may be movable by being pivotable about a second movable pupil axis Amp2.

The first movable pupil member 154*a* includes a representation of a first pupil 155*a* thereon. The representation of the first pupil 155*a* is eccentric relative to the first movable pupil member axis Amp1. The second movable pupil member 154*b* includes a representation of a second pupil 155*b* thereon. The representation of the second pupil 155*b* is eccentric relative to the second movable pupil member axis Amp2.

The first and second movable pupil members 154*a* and 154*b* are movable between a first pupil position in which the first and second movable pupil members 154*a* and 154*b* generally face towards the first traveler position, and a second pupil position in which the first and second movable pupil members 154*a* and 154*b* generally face towards the second traveler position. In other words, in the first pupil position the representations of the first and second pupils 155*a* and 155*b* face towards the first traveler position, and in the second pupil position the representations of the first and second pupils 155*a* and 155*b* face towards the second traveler position.

The storage device 100 includes at least one actuator 410 that is operatively connected to the at least one movable facial feature element 154 for driving movement of the at least one movable facial feature element 154.

In the present example the at least one actuator 410 includes a first actuator 410*a* and a second actuator 410*b*, which are connected to the movable facial feature elements 154*a* and 154*b*, respectively.

Figure 4A:
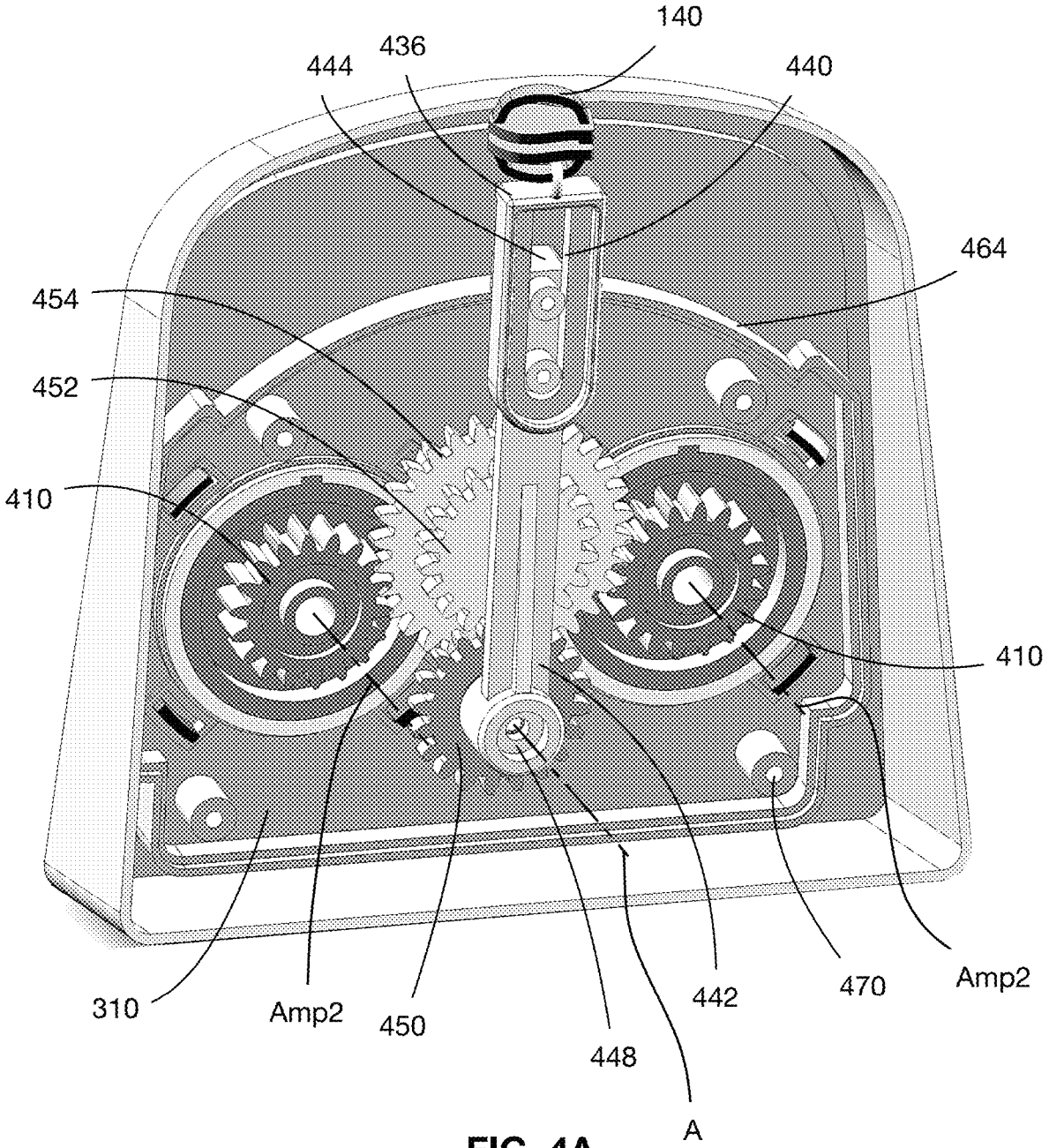
FIG. 4A is a perspective sectional view of the storage device shown in FIG. 1, illustrating a coupling arrangement that connects the traveler to gears that drive movement of the movable facial feature elements, with the traveler in between a first position and a second position.

In an embodiment of the storage device 100 presented in FIG. 4A, the actuation of the actuator 410 to drive the movement of the movable portion of the one or more facial feature structures 150 is in turn driven by the movement of the traveler 140 along the closure structure 210.

The one or more facial feature structures 150 may be mounted on an exterior side face of the pair of side faces 120, and may thus be visible from outside the storage device 100. The one of the pair of side faces 120 may include an aperture that is covered by the one or more facial feature structures 150, and through which a portion of the at least one actuator 410 may extend from the interior of the container 110 to connect with the one or more facial feature structures 150.

Figure 4C:
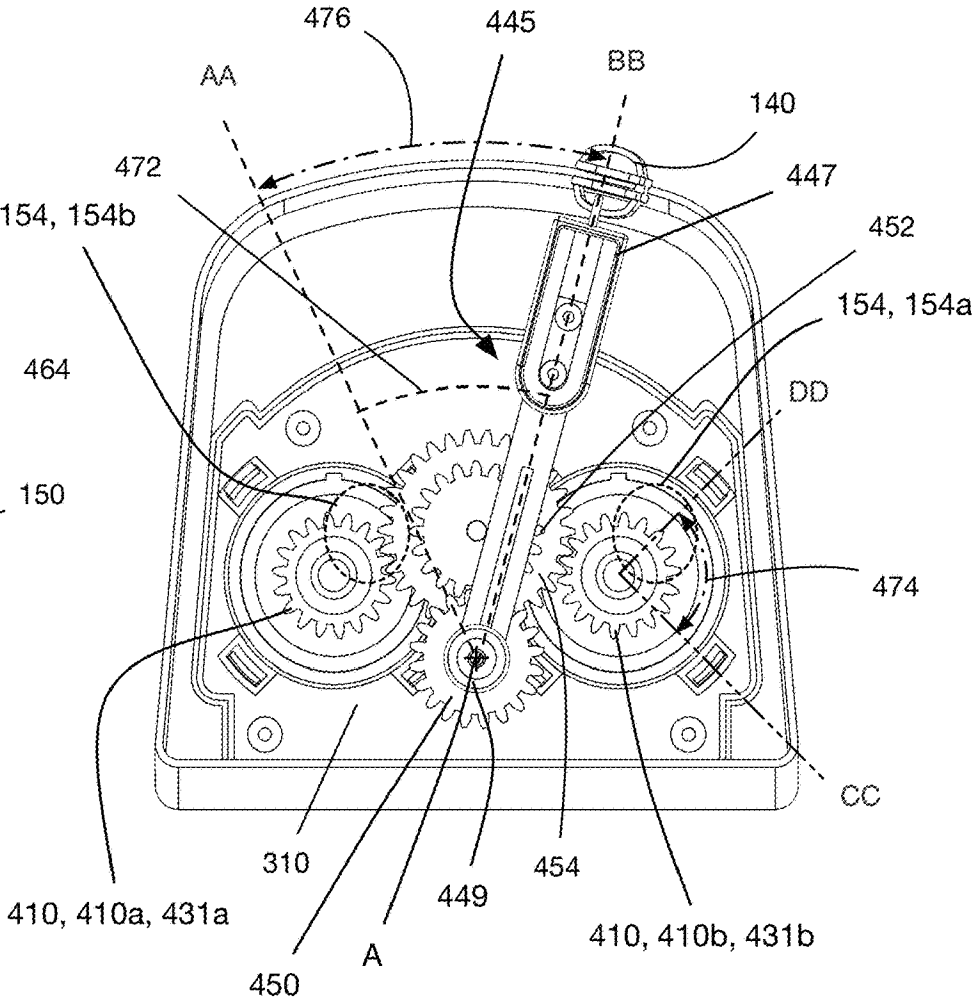
FIG. 4C is another perspective sectional view of the storage device shown in FIG. 1, with the traveler in the second position.
Figure 4B:
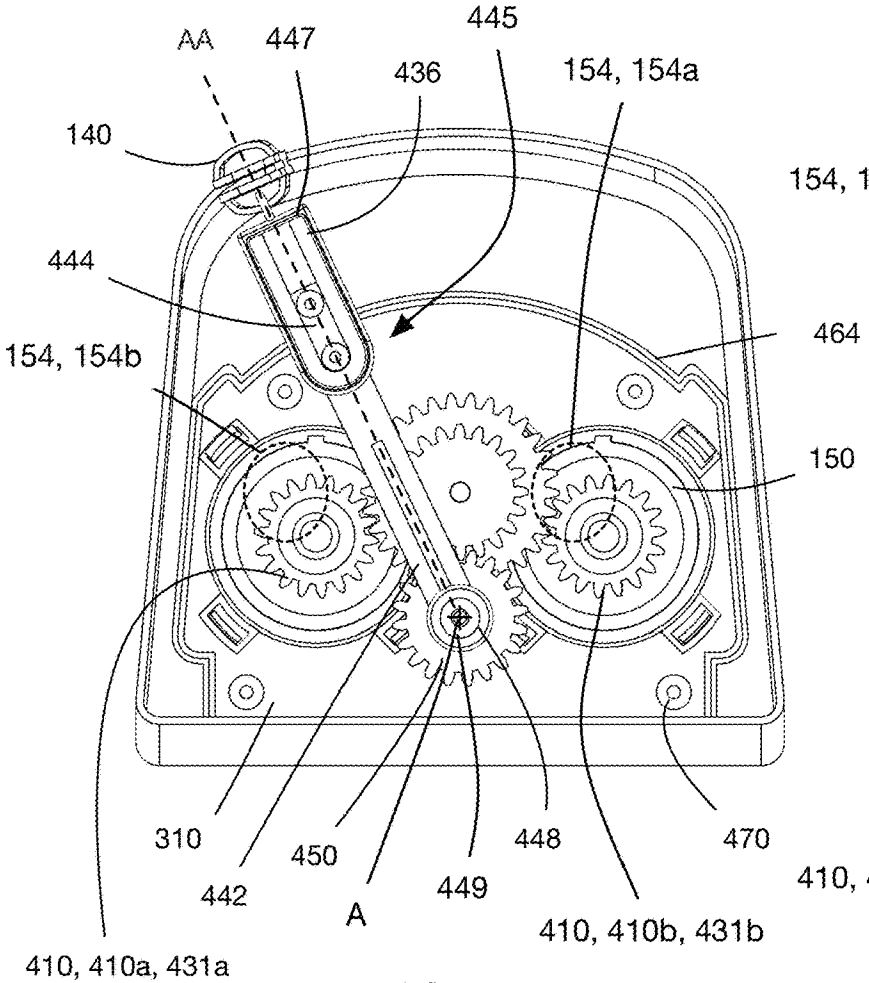
FIG. 4B is another perspective sectional view of the storage device shown in FIG. 1, with the traveler in the first position.

In the embodiment presented in FIGS. 4A and 4B, the storage device 100 further includes a coupling arrangement 430, that is optionally at least partially disposed in the interior of the that connects the actuator 410 associated with the one or more facial feature structures 150.

Referring to FIG. 4B and FIG. 4C, the coupling arrangement 430 generally connects the actuator 410 and traveler 140 together, such that movement of the traveler 140 between the first traveler position and the second traveler position drives movement of the first and second actuators 410*a* and 410*b*, which in turn drives movement of the first and second movable pupil members 154*a* and 154*b*, between the first pupil position (FIG. 4B) and the second pupil position (FIG. 4C), so as to present an appearance of the representations of the first and second pupils 155*a* and 155*b* following the traveler 140 during movement of the traveler 140.

In the particular embodiment shown, a sliding of the traveler 140 between one of a first position (position AA) and a second position (position BB) along the closure structure 210 to the other of the first position (position AA) and the second position (position BB) drives movement of the actuator 410, which, in turn, drives the movement of the at least one movable facial feature structures 154. The distance 476 between the first and second traveler positions (AA and BB) along which the traveler 140 travels correspond to an actuating distance 474 travelled by the actuator 410 and the movable portion (pupil members 154). In the present embodiment, the actuating distance 474 is a radial distance between first and second positions of the actuators, (position CC and position DD).

In the embodiment presented in FIGS. 4B and 4C the coupling arrangement 430 includes an extensible link 445 that is connected at a first end 447 to the traveler 140 and which is pivotally connected at a second end 449 to a structural element in the storage device 100 for pivoting about a link pivot axis A. In the example shown in FIG. 5 the extensible link 445 is pivotally connected at a second end 449 to a portion of an inner support panel 510 that is described further below.

A driver gear 451 is fixed to the extensible link 445 so as to pivot about the link pivot axis A during pivoting of the extensible link 445.

At least one transfer gear is engaged with the driver gear 450 and is operatively connected to the at least one actuator 410.

By providing the extensible link 445 the travel path of the traveler 140 can differ from a perfectly circular arc. This permits the shape of the portion of the storage device 100 that has the closure structure 210 to be other than a perfectly circular arc. In the embodiment shown in the figures, the portion of the storage device 100 that has the closure structure is shaped like a flattened arc.

Figure 5:
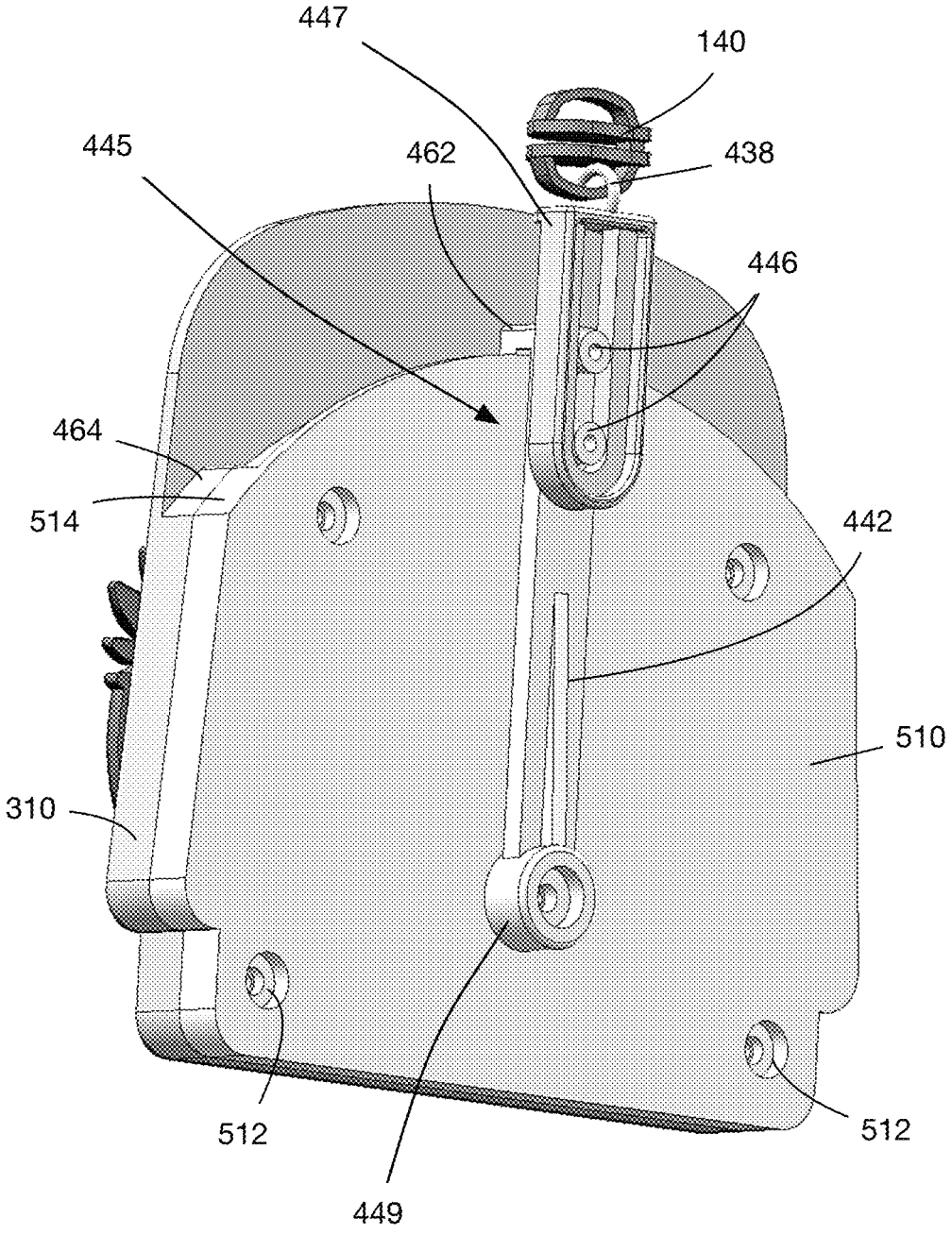
FIG. 5 shows a housing that houses a portion of the coupling arrangement for the storage device shown in FIG. 1.
Figure 6:
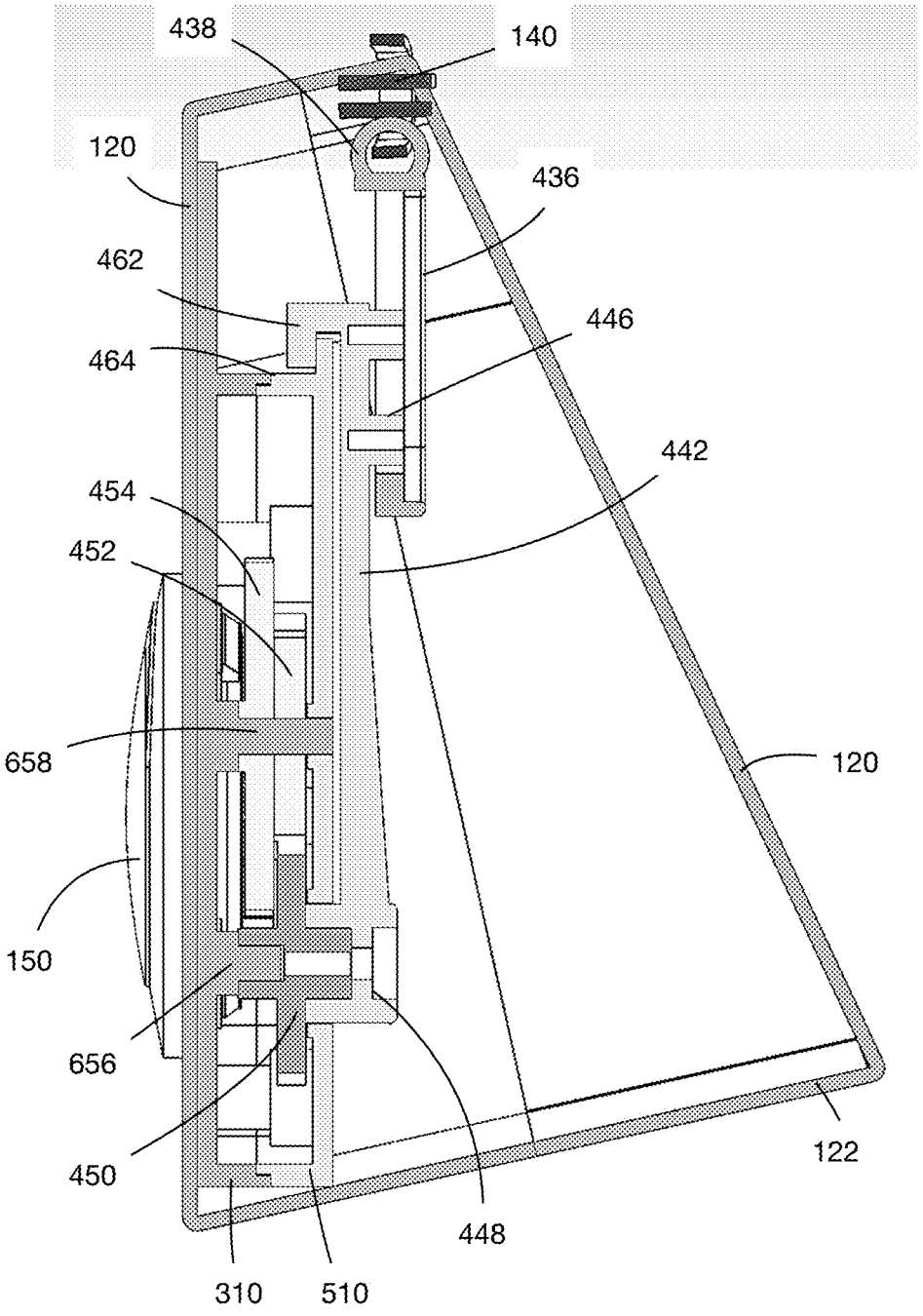
FIG. 6 shows a sectional side view of the storage device shown in FIG. 1.

Referring to FIGS. 3, 4 and 5, in an embodiment, the actuator 410 and coupling arrangement 430 are disposed within the storage pocket of the container 110 is provided. In this embodiment, a rigid outer support panel 310 is fixed against an interior surface of one of the pair of side faces 120. In the present embodiment, both the outer support panel 310 and the one of the pair of side faces 120 upon which the support panel 310 is fixed include at least one aperture (in the present example there are a pair of apertures 330, 332) sized to fit the one or more movable facial feature elements 154.

In an embodiment, with reference to FIG. 4A, the at least one actuator 410 of the at least one movable facial feature element 154, includes a first final gear 431*a* that is fixed to the first movable pupil member 154*a*, and which is pivotable about the first movable pupil axis Amp1, and further includes a second final gear 431*b* that is fixed to the second movable pupil member 154*b* and which is pivotable about the second movable pupil axis Amp2.

The coupling arrangement 430 may include a gear arrangement 432 that is operatively connected to the traveler 140 via the extensible link 445, which, in the present example includes a set of connecting links, which includes two sub-links, a channel link 436 and a pivoting link 442.

The channel link 436 includes a hook 438 on an end thereof that is shaped to be latched onto a loop on a bottom portion of the traveler 140, thereby connecting the channel link 436 and the traveler 140 while still permitting three degrees-of freedom of pivoting of the channel link 436 relative to the traveler 140. The channel link 436 also includes a channel 440 extending along part of its length.

The pivoting link 442 includes a sliding end 444 and a pivoting end 448. The sliding end 444 includes at least two protrusions 446 formed thereon, the at least two protrusions 446 being sized to be received in and to slide along channel 440 of the channel link 436 to support a sliding of the channel link 436 along a length of the pivoting link 442. The sliding end 444 of the pivoting link 442 includes a sliding tab 462 formed on the opposite side of the at least two protrusions 446. The sliding tab 462 of the pivoting link 442 is formed to be supported on an arced, support surface 464 of the outer support panel 310. In an embodiment, the form of the arced, support surface 464 approximately following a radius of curvature of the closure structure 210 supported on the top panel of the container 110.

The pivoting end 448 of the pivoting link 442 includes a fixed driver gear 450 which is pivotably mounted about a first shaft 656 at a fixed rotation point on an inner surface 420 of the outer support panel 310.

The gear arrangement 432 of the coupling arrangement 430, in the particular embodiment shown, includes a first transfer gear 452 and a second transfer gear 454, which co-rotate with one another and which are both pivotably mounted to a transfer gear shaft 658 on the inner surface 420 of the outer support panel 310). The first transfer gear 452 is positioned to mesh with the driver gear 450 and the second transfer gear 454 is positioned to extend between and mesh with each of the gears of the actuators 410*a* and 410*b*.

The extensible link 445 in the present example, includes a first link 436 which may be referred to as a channel link 436, and a second link 442 which is slidably connected to the first link and which may be referred to as a pivoting link 442.

Movement of the traveler 140 drives movement of the first end 447 of the extensible link 445, which in turn drives pivoting of the extensible link 445 about the link pivot axis A, which drives the driver gear 450, which in turn drives the at least one actuator 410 through the plurality of transfer gears 452 and 454, which in turn drives movement of the at least one movable facial feature element 154. Specifically with reference to the example in FIG. 4B and FIG. 4C, movement of the traveler 140 along the closure structure 210 between the first position (position AA) and the second position (position BB) produces a corresponding motion of the at least one actuator 410. The sliding motion of the traveler 140 is transmitted from the traveler 140 to the channel link 436 and then to the pivoting link 442. As the traveler 140 is slid along the closure structure 210, the sliding tab 462 of the pivoting link 442 is supported to slide along the arced support surface 464 such that the sliding motion of the traveler 140 is translated to the pivoting link 442 for pivoting a rotational distance 472 about the link pivot axis A on the outer support panel 310.

As the pivoting link 442 pivots about the fixed point of the pivoting end 448, the driver gear 450 drives a rotation of the first and second transfer gears 452, 454 of the gear arrangement 432, which in turn drives a rotation of the gears of the actuators 410 of the eyes across the actuating distance 474 between first and second positions of the actuator (position CC and position DD). The rotation of the actuators 410 between first and second positions drives a rotation of the eyeballs on the eyes.

In an embodiment where the sliding of the traveler 140 from the first position to the second position drives an actuation of the actuators 410 corresponding to each of the pair of eye structures which in turn drives the rotation of the eyeballs, the eyeball of each of the pair of eyes rotate from a first rotational position to a second rotational position so as to imitate an appearance of the eyeball of each of the pair of eyes following a position of the traveler 140 as it is slid along the closure structure 210.

In an embodiment present in FIG. 5, the interior of the container 110 further includes an inner support panel 510 having a matching form to that of the outer support panel 310, the inner support panel 510 including an arced, top surface 514 corresponding to the arced, support surface 464 of the outer support panel 310. The inner support panel 510 is mounted on the outer support panel 310, wherein the inner and outer support panel 310 form a housing for the gear arrangement 432 and the actuators 410 of the one or more facial feature structures 150.

In the present embodiment, the outer support panel 310 includes a plurality of connection protrusions 470. The inner support panel 510 includes a plurality of connection apertures 512 sized to receive the connection protrusions 470 for mounting thereon. The inner support panel 510 also includes a connection aperture 512 through which the driver gear 450 is fixed to the pivoting end 448 of the pivoting link 442.

Figure 7A:
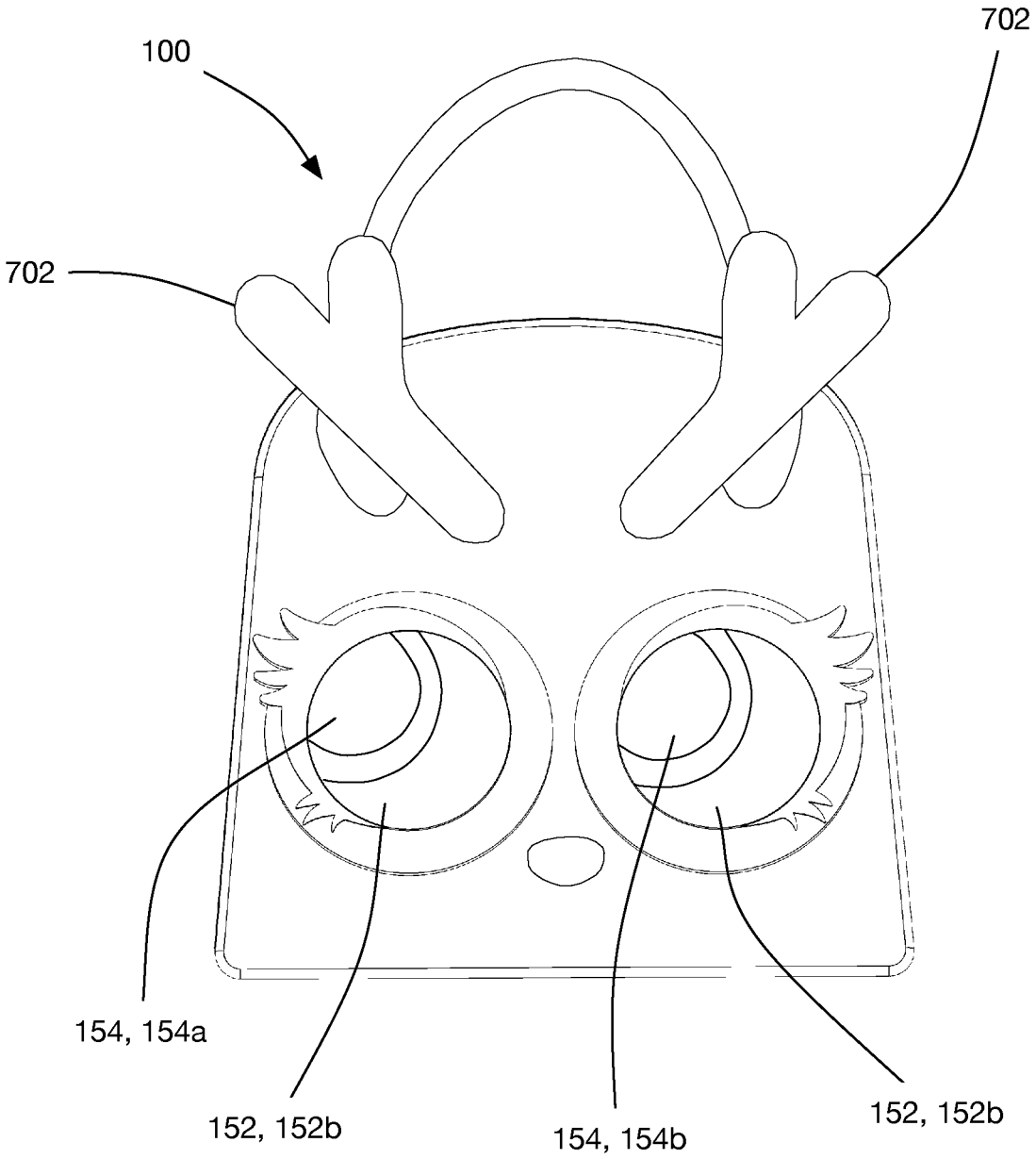
FIG. 7A shows an embodiment of the storage device adorned to resemble a deer.
Figure 7B:
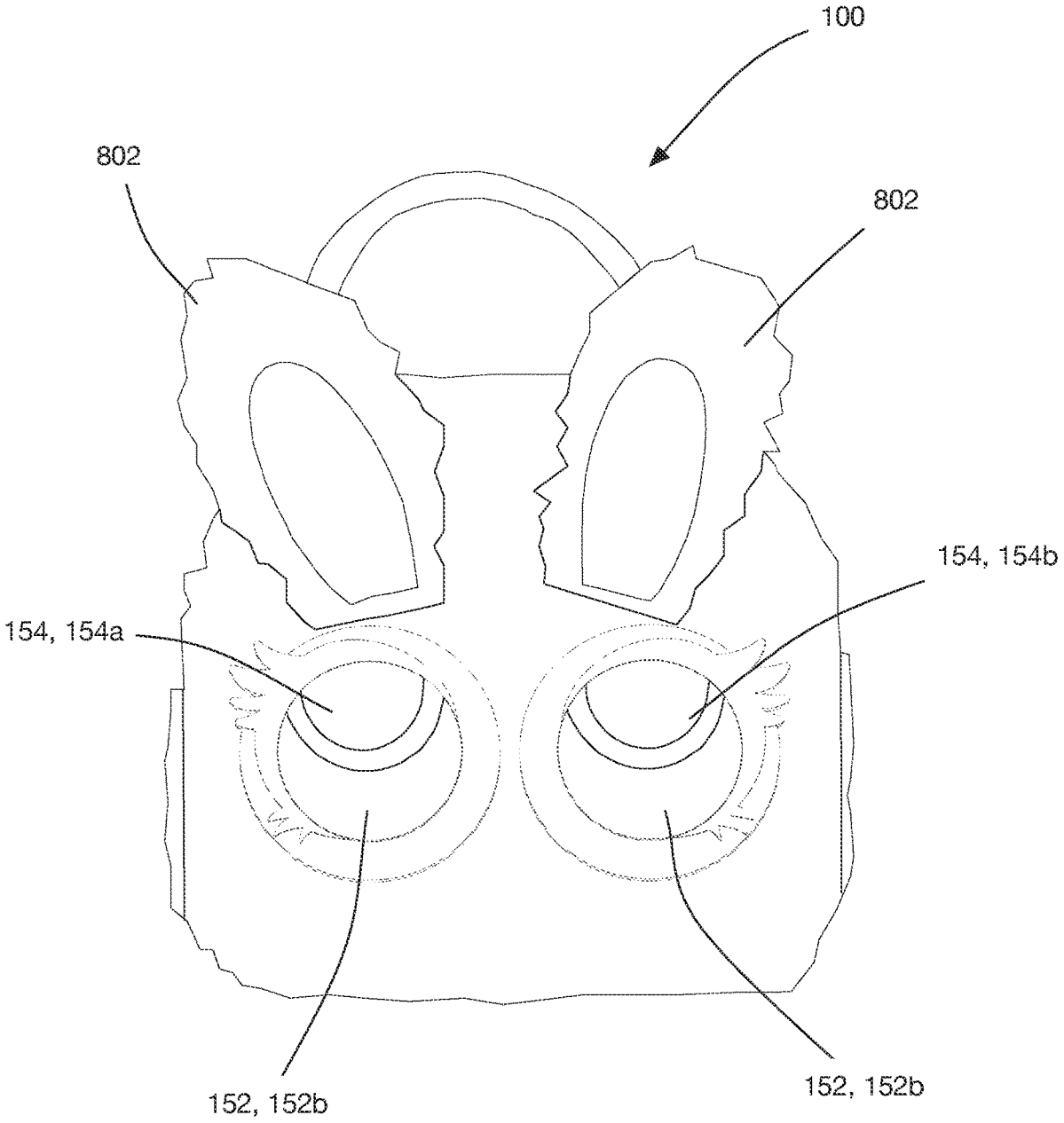
FIG. 7B shows an embodiment of the storage device adorned to resemble a rabbit.

As noted previously, an embodiment of the storage device 100 includes the container 110, which constitutes a main frame of the storage device 100 and acts as the "head" of the caricatured animal. Referring to FIG. 7A-7B, a number of embodiments of the storage device 100 adorned to resemble a number of different animals are provided. The adornments to impart an animal-like appearance are generally formed on the exterior of the container 110. A variety of fabrics may be fixed to the exterior surfaces and may have a variety of textures and colors. A variety of accessories and members may also be fixed to the exterior surfaces.

In the example presented in FIG. 7A, the exterior surfaces of the storage device 100 are adorned to resemble a deer, and includes antlers 702, a nose, ears and multicolored fabric to match a realistic pattern of colored fur. A variety of fabrics may be fixed to the exterior surfaces and may have a variety of textures and colors. In the example presented in FIG. 7B, the exterior surfaces of the storage device 100 are adorned to resemble a rabbit and includes long ears 802 and a fluffy fabric covering the exterior surfaces of the container.

The storage device 100 may be in the form of a purse, as shown in the figures. Alternatively, the storage device 100 may be in the form of any other type of device, such as a backpack, a pencil case, or any other suitable type of storage device.

While the storage device 100 has been shown to include a first movable facial feature element 154*a* and a second movable facial feature element 154*b*, it is possible in an alternative embodiment for the storage device 100 to include the first movable facial feature element 154*a* and to omit the second movable facial feature element 154*b*. In both such an alternative embodiment, and also in the embodiments shown in the figures, it may be said that the at least one facial feature structure 150 includes a first eye structure 152*a*, and the at least one movable facial feature element 154 includes a first movable pupil member 154*a*. Additionally, it may be said that the at least one actuator 410 includes a first actuator 410*a* that is operatively connected to the first movable pupil member 154*a*. It may additionally be said that the first movable pupil member 154*a* is movable between a first pupil position (FIG. 4B) in which the representation of the first pupil 155*a* faces towards the first traveler position, and a second pupil position (FIG. 4C) in which the representation of the first pupil 155*a* faces towards the second traveler position. It may further be said that the coupling arrangement 430 connects the first actuator 410*a* and the traveler 140 together, such that movement of the traveler 140 between the first traveler position and the second traveler position drives movement of the first actuator 410*a*, which in turn drives movement of the first movable pupil member 154*a* between the first pupil position and the second pupil position, so as to present an appearance of the representation of the first pupil 155*a* following the traveler 140 during movement of the traveler 140.

While it has been described for the storage device to include at least one facial feature structure, which includes at least one movable facial feature element, it will be understood that the at least one facial feature structure may, more broadly, be at least one feature structure that includes a representation of a feature of an animate object. The animate object represented is an object that that is distinct from the storage device. For example, the animate object may be an animal, a robot, or an analog clock, (since all of these aforementioned objects are animate), or any other suitable animate object. The at least one feature structure may, more broadly, be said to include at least one movable feature element, which could be any movable feature element of an animate object. For example, the movable feature element may be shaped to appear as a tail of the aforementioned animal, an arm of the aforementioned robot, or a minute hand of the aforementioned analogy. These are but a few examples of some movable feature elements and animate objects.

The above-described embodiments are intended to be examples of the present disclosure and alterations and modifications may be affected thereto, by those of skill in the art, without departing from the scope of the invention that is defined solely by the claims appended hereto.

What is claimed is:

1. A storage device for carrying items, comprising:

a container defining an interior for storage of items, the container including an exterior surface and an opening therethrough for accessing the interior;

at least one feature structure that is visible from outside the storage device, the at least one feature structure including a representation of a feature of an animate object that that is distinct from the storage device, the at least one feature structure including at least one movable feature element;

at least one actuator that is operatively connected to the at least one movable feature element for driving movement of the at least one movable feature element;

a closure structure extending along the opening;

a traveler being movably mounted to the closure structure for movement between a first traveler position and a second traveler position, wherein, movement of the traveler towards the first traveler position opens the closure structure so as to open the opening, and movement of the traveler towards the second traveler position closes the closure structure to close the opening; and a coupling arrangement operatively connecting the traveler to the actuator such that movement of the traveler from one of the first traveler position and the second position to the other of the first traveler position and the second position drives movement of the at least one actuator, which in turn drives movement of the at least one movable feature element, wherein the closure structure includes a pair of rows of corresponding zipper teeth extending along opposing sides of the opening;

and wherein the traveler is a zipper slider slidably mated to the pair of rows of corresponding zipper teeth for connecting and separating thereof.

2. The storage device of claim 1, wherein the at least one feature structure is a facial feature structure and the representation of the feature of the animate object is a representation of a facial feature, and wherein the at least one movable feature element is at least one movable facial feature element of the facial feature structure.

3. The storage device of claim 2, wherein the at least one facial feature structure includes a first eye structure and a second eye structure, and the at least one movable facial feature element includes a first movable pupil member and a second movable pupil member and wherein the at least one actuator includes a first actuator that is operatively connected to the first movable pupil member, and a second actuator that is operatively connected to the second movable pupil member.

4. The storage device of claim 3, wherein the first movable pupil member includes a representation of a first pupil thereon, and the second movable pupil member includes a representation of a second pupil thereon, wherein the first and second movable pupil members are movable between a first pupil position in which the representations of the first and second pupils face towards the first traveler position, and a second pupil position in which the representations of the first and second pupils face towards the second traveler position, and wherein the coupling arrangement connects the first and second actuators and the traveler together, such that movement of the traveler between the first traveler position and the second traveler position drives movement of the first and second actuators, which in turn drives movement of the first and second movable pupil members between the first pupil position and the second pupil position, so as to present an appearance of the representations of the first and second pupils following the traveler during movement of the traveler.

5. The storage device of claim 1, wherein the coupling arrangement includes:

an extensible link connected at a first end to the traveler and pivotally connected at a second end to a structural element in the storage device;

a driver gear fixed to the extensible link so as to pivot during pivoting of the extensible link;

at least one transfer gear that are engaged with the driver gear and which are operatively connected to the at least one actuator;

wherein, movement of the traveler drives movement of the first end of the extensible link, which in turn drives pivoting of the extensible link, which drives the driver gear, which in turn drives the at least one actuator through the at least one transfer gear, which in turn drives movement of the at least one movable feature element.

6. The storage device of claim 5, wherein the at least one feature structure is a facial feature structure and the representation of the feature of the animate object is a representation of a facial feature, and wherein the at least one movable feature element is at least one movable facial feature element of the facial feature structure, wherein the at least one facial feature structure includes a first eye structure and a second eye structure, and the at least one movable facial feature element includes a first movable pupil member and a second movable pupil member and wherein the at least one actuator includes a first actuator that is operatively connected to the first movable pupil member, and a second actuator that is operatively connected to the second movable pupil member, wherein the first movable pupil member is pivotable about a first movable pupil member axis and the second movable pupil member is pivotable about a second movable pupil member axis, and wherein the at least one actuator includes a first final gear that is fixed to the first movable pupil member and which is rotatable about the first movable pupil axis, and a second final gear that is fixed to the second movable pupil member and which is rotatable about the second movable pupil axis, and wherein the first movable pupil member includes a representation of a first pupil that is eccentric relative to the first movable pupil member axis, and the second movable pupil member includes a representation of a second pupil that is eccentric relative to the second movable pupil member axis.

7. The storage device of claim 5, wherein the at least one feature structure is a facial feature structure and the representation of the feature of the animate object is a representation of a facial feature, and wherein the at least one movable feature element is at least one movable facial feature element of the facial feature structure, wherein the at least one facial feature structure includes a first eye structure, and the at least one movable facial feature element includes a first movable pupil member, and wherein the at least one actuator includes a first actuator that is operatively connected to the first movable pupil, wherein the first movable pupil member is pivotable about a first movable pupil member axis, and wherein the at least one actuator includes a first final gear that is fixed to the first movable pupil member and which is rotatable about the first movable pupil member axis, and wherein the first movable pupil member includes a representation of a first pupil that is eccentric relative to the first movable pupil member axis.

8. The storage device of claim 2, wherein the at least one facial feature structure includes a first eye structure, and the at least one movable facial feature element includes a first movable pupil member, and wherein the at least one actuator includes a first actuator that is operatively connected to the first movable pupil member.

9. The storage device of claim 8, wherein the first movable pupil member includes a representation of a first pupil thereon, wherein the first movable pupil member is movable between a first pupil position in which the representation of the first pupil faces towards the first traveler position, and a second pupil position in which the representation of the first pupil faces towards the second traveler position, and wherein the coupling arrangement connects the first actuator and the traveler together, such that movement of the traveler between the first traveler position and the second traveler position drives movement of the first actuator, which in turn drives movement of the first movable pupil member between the first pupil position and the second pupil position, so as to present an appearance of the representation of the first pupil following the traveler during movement of the traveler.

10. A storage device for carrying items, comprising:

a container defining an interior for storage of items, the container including an exterior surface and an opening therethrough for accessing the interior;

at least one feature structure that is visible from outside the storage device, the at least one feature structure including a representation of a feature of an animate object that that is distinct from the storage device, the at least one feature structure including at least one movable feature element;

at least one actuator that is operatively connected to the at least one movable feature element for driving movement of the at least one movable feature element;

a closure structure extending along the opening;

a traveler being movably mounted to the closure structure for movement between a first traveler position and a second traveler position, wherein, movement of the traveler towards the first traveler position opens the closure structure so as to open the opening, and movement of the traveler towards the second traveler position closes the closure structure to close the opening; and a coupling arrangement operatively connecting the traveler to the actuator such that movement of the traveler from one of the first traveler position and the second position to the other of the first traveler position and the second position drives movement of the at least one actuator, which in turn drives movement of the at least one movable feature element, wherein the coupling arrangement includes:

an extensible link connected at a first end to the traveler and pivotally connected at a second end to a structural element in the storage device;

a driver gear fixed to the extensible link so as to pivot during pivoting of the extensible link;

at least one transfer gear that are engaged with the driver gear and which are operatively connected to the at least one actuator;

wherein, movement of the traveler drives movement of the first end of the extensible link, which in turn drives pivoting of the extensible link, which drives the driver gear, which in turn drives the at least one actuator through the at least one transfer gear, which in turn drives movement of the at least one movable feature element.

11. The storage device of claim 10, wherein the at least one feature structure is a facial feature structure and the representation of the feature of the animate object is a representation of a facial feature, and wherein the at least one movable feature element is at least one movable facial feature element of the facial feature structure, wherein the at least one facial feature structure includes a first eye structure and a second eye structure, and the at least one movable facial feature element includes a first movable pupil member and a second movable pupil member and wherein the at least one actuator includes a first actuator that is operatively connected to the first movable pupil member, and a second actuator that is operatively connected to the second movable pupil member, wherein the first movable pupil member is pivotable about a first movable pupil member axis and the second movable pupil member is pivotable about a second movable pupil member axis, and wherein the at least one actuator includes a first final gear that is fixed to the first movable pupil member and which is rotatable about the first movable pupil axis, and a second final gear that is fixed to the second movable pupil member and which is rotatable about the second movable pupil axis, and wherein the first movable pupil member includes a representation of a first pupil that is eccentric relative to the first movable pupil member axis, and the second movable pupil member includes a representation of a second pupil that is eccentric relative to the second movable pupil member axis.

12. The storage device of claim 11, wherein the at least one facial feature structure includes a first eye structure, and the at least one movable facial feature element includes a first movable pupil member, and wherein the at least one actuator includes a first actuator that is operatively connected to the first movable pupil member.

13. The storage device of claim 12, wherein the first movable pupil member includes a representation of a first pupil thereon, wherein the first movable pupil member is movable between a first pupil position in which the representation of the first pupil faces towards the first traveler position, and a second pupil position in which the representation of the first pupil faces towards the second traveler position, and wherein the coupling arrangement connects the first actuator and the traveler together, such that movement of the traveler between the first traveler position and the second traveler position drives movement of the first actuator, which in turn drives movement of the first movable pupil member between the first pupil position and the second pupil position, so as to present an appearance of the representation of the first pupil following the traveler during movement of the traveler.

14. The storage device of claim 10, wherein the at least one feature structure is a facial feature structure and the representation of the feature of the animate object is a representation of a facial feature, and wherein the at least one movable feature element is at least one movable facial feature element of the facial feature structure, wherein the at least one facial feature structure includes a first eye structure, and the at least one movable facial feature element includes a first movable pupil member, and wherein the at least one actuator includes a first actuator that is operatively connected to the first movable pupil, wherein the first movable pupil member is pivotable about a first movable pupil member axis, and wherein the at least one actuator includes a first final gear that is fixed to the first movable pupil member and which is rotatable about the first movable pupil member axis, and wherein the first movable pupil member includes a representation of a first pupil that is eccentric relative to the first movable pupil member axis.

* * * * *